US005292245A

United States Patent [19]

Spoonhour

[11] Patent Number: 5,292,245

[45] Date of Patent: Mar. 8, 1994

[54] PLASTIC HAND HELD CANDLE HOLDER

[76] Inventor: Kenneth A. Spoonhour, 6 Drexel Hills Cir., New Cumberland, Pa. 17070

[21] Appl. No.: 935,914

[22] Filed: Aug. 27, 1992

[51] Int. Cl.[5] ..... F23D 3/16

[52] U.S. Cl. ..... 431/292; 431/294

[58] Field of Search ..... 431/292, 288, 296, 297, 431/293, 294, 295

[56] References Cited

U.S. PATENT DOCUMENTS

| | | | |
|---|---|---|---|
| 401,592 | 4/1889 | Roelofs | 431/294 |
| 837,240 | 11/1906 | Mulkerins | 431/294 |
| 1,195,657 | 8/1916 | Chersky | 431/294 |
| 1,817,834 | 8/1931 | Orme | 431/292 |
| 2,111,642 | 3/1938 | Saier | 431/297 |
| 2,696,097 | 12/1954 | Pernici | 431/296 X |
| 2,987,901 | 6/1961 | Coffey | 67/23 |
| 3,242,526 | 7/1964 | Wilton et al. | 18/1 |
| 4,759,699 | 7/1988 | Rubarth | 431/291 |
| 4,894,008 | 1/1990 | Lee | 431/290 |

FOREIGN PATENT DOCUMENTS

| | | | |
|---|---|---|---|
| 22408 | 12/1893 | United Kingdom | 431/292 |
| 173845 | 1/1922 | United Kingdom | 431/292 |

*Primary Examiner*—Larry Jones
*Attorney, Agent, or Firm*—Thomas Hooker

[57] ABSTRACT

A plastic hand held candle holder having an integral body made from polypropylene which includes a tubular handle having a closed end, an open end and a cup extending upwardly from the open end of the handle. A plurality of elongate ridges extend longitudinally along the interior of the handle. These ridges hold the stem of a candle in a stationary position in the holder.

23 Claims, 2 Drawing Sheets

PLASTIC HAND HELD CANDLE HOLDER

FIELD OF THE INVENTION

The invention relates to candle holders and more particularly to a hand held candle holder used to catch melted wax flowing down along the stem of the candle.

DESCRIPTION OF THE PRIOR ART

Hand held candle holders are commonly used during candle light services. During such services, a person holds a lighted candle in the candle holder. The lighted candle burns continuously throughout the service. As the candle burns, the candle wax melts and drips down from the stem of the candle. A shield catches the hot wax and protects the person holding the candle from being burned by the wax.

A typical conventional hand held candle holder consists of a flat, circular cardboard disc having a centrally located aperture. The candle is inserted through the aperture, and the disc is slidably positioned along the candle body to a location which allows the disc to collect dripping wax.

However, the circular disc has no means for gripping the body of the candle as it burns. The disc is free to move along the length of the candle body. Such movement may occur when the person holding the candle contacts the circular disc. The disc may also displace under the weight of the solidified wax which dripped down onto the face of the circular disc. As a result of the movement of the disc, the person holding the candle is at greater risk of being contacted by the dripping liquid wax. Melted wax may leak down between the disc and candle.

Also, because the cardboard candle holder is flat, the wax may flow off of the face of the holder prior to solidifying. This may occur when the disc is tilted slightly from the horizontal.

SUMMARY OF THE INVENTION

The present invention is a molded plastic candle holder having an integral body consisting of a concave circumferential cup or shield and a tapered closed tubular handle. The stem of a candle is placed into the handle and a plurality of elongate ridges on the interior wall of the handle wedge into the wax body of the candle stem and hold the candle in a stationary upright position, eliminating movement of the candle relative to the holder during burning. As the candle is burned, the wax accumulates within the recess of the hollow concave shield. The hollow shape of the shield assures that melted wax is retained in the shield even if the candle is tilted from the vertical position. Also, since the candle is maintained in a fixed position in the center of the holder, all of the wax drips down the body of the candle and collects within the shield.

The tapered handle of the candle holder allows individual candle holders to be stacked on top of one another when they are not in use. The candle holder is preferably molded from polypropylene plastic. Candle wax does not stick to polypropylene plastic. Hardened candle wax is easily removed from the holder prior to stacking the candle holder.

Gussets located at the outside junction between the shield and the handle add strength to the candle holder necessary during the manufacture of the holder. The gussets prevent the inversion of the cup when the candle holder is ejected from plastic molding tooling.

When the candle holder is ejected from the molding tooling, the ejectors apply pressure on the interior of the shield to push the shield and handle from the male mold part. The gussets prevent the handle from inverting during ejection from the male mold part in the handle.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 3:
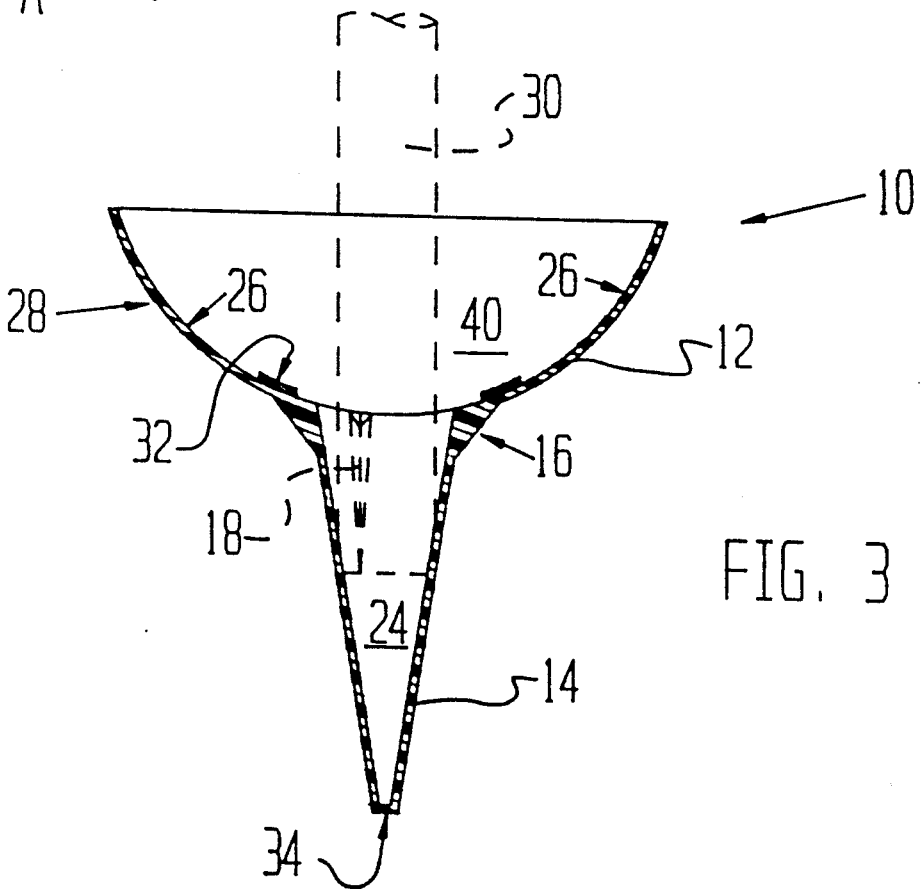
FIG. 3 is a vertical sectional view taken along line A—A of FIG. 2.

Candle holder 10 has an integral molded plastic body consisting of a hollow semi-spherical cup 12 and a tapered hollow tubular handle 14 extending outwardly from the bottom of the cup. The tubular handle has an open end joining the cup and a closed end away from the cup. The stem of candle 30 is inserted through the cup and into the open end of the handle as indicated in FIG. 3.

Cup 12 has an interior surface 26 and an exterior surface 28. Opening 36 leading into the handle is located along the central axis of cup 12 at a location at the bottom of surface 26.

The walls of handle 14 join the perimeter of hole 36 at the bottom of cup 12, and taper downward and inward until joining at closed end 34 to seal the hollow handle. When the candle is placed in the candle holder, the stem of the candle is inserted through hole 36 into interior 24 of handle 14. The stem is moved into the handle 24 until it contacts and is wedged against the interior walls of the handle. The interior cross section at the top of the tapered handle is larger than the cross section of the stem of the candle and the interior cross section of the bottom of the handle is smaller than the cross section of the stem of the candle.

Sharp edged elongate triangular ridges 20 extend downward along interior wall of handle 14. In the present candle holder there are three ridges located along the walls of the handle. However, the candle holder may include a different number of ridges if desired. These ridges are located to engage the edges of the candle inserted in the candle holder. The ridges are arranged equidistantly along the handle to assure capture of the stem.

Figure 1:
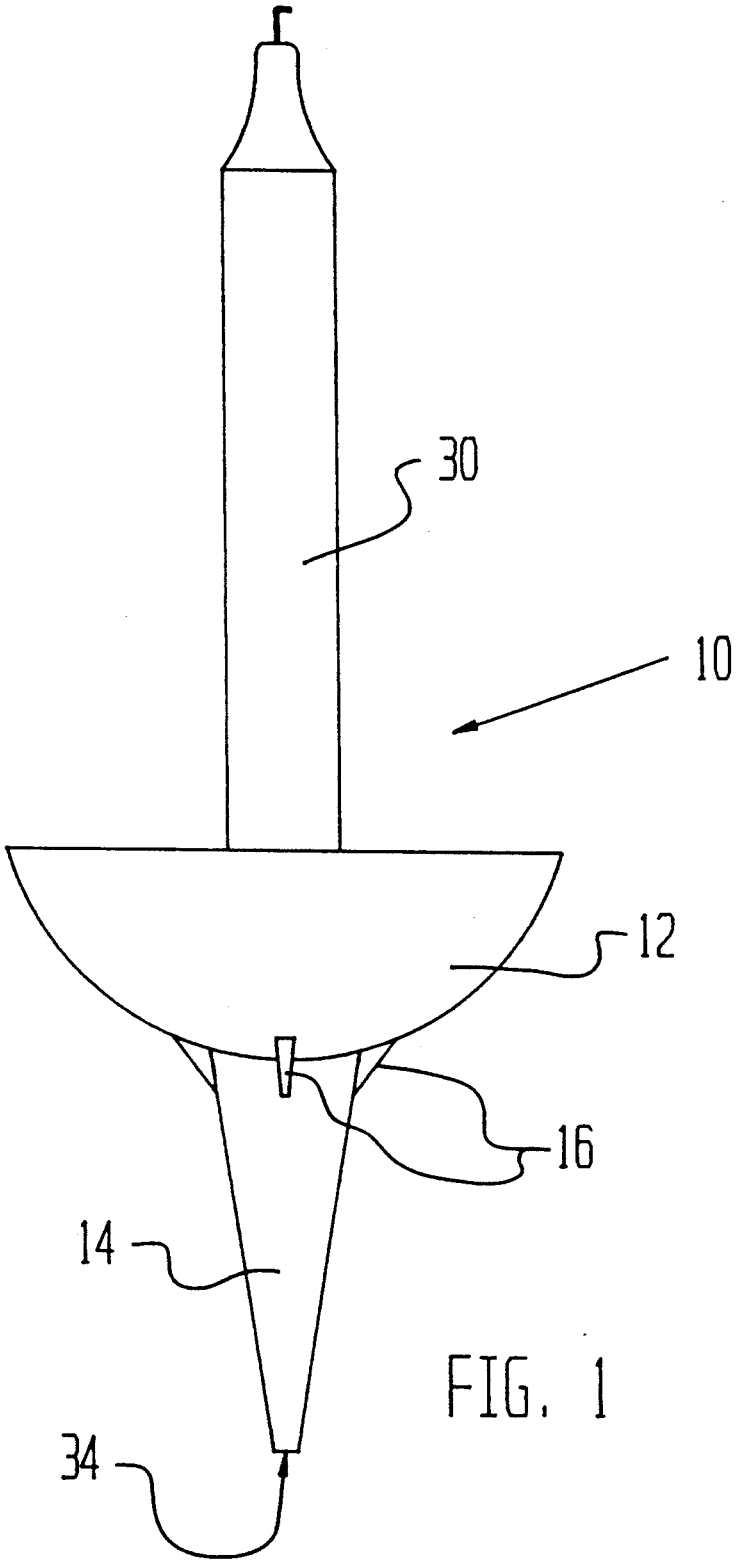
FIG. 1 is a side view of a candle holder and candle.
Figure 2:
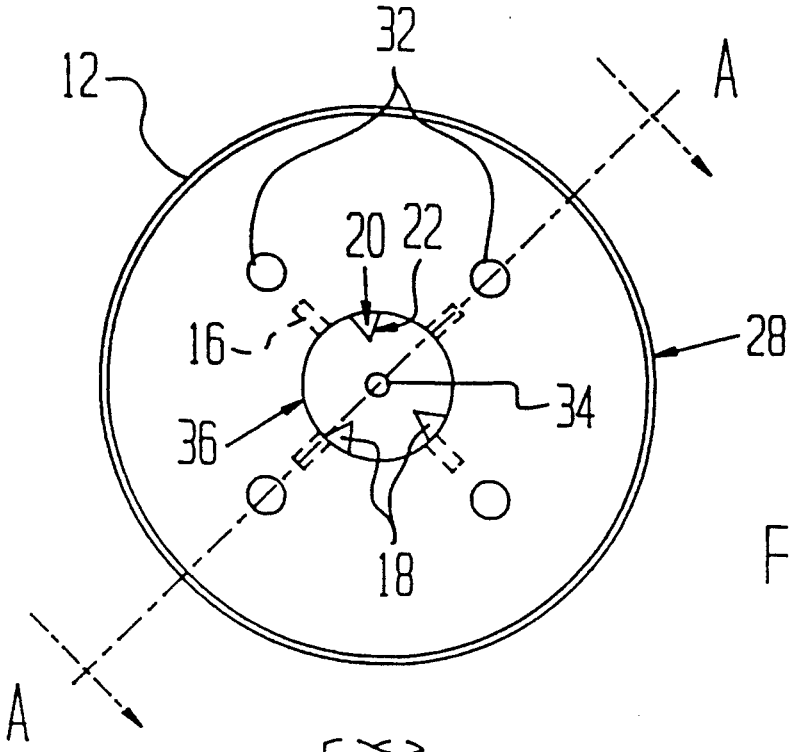
FIG. 2 is a top view of the candle holder.

Each ridge 18 has a triangularly shaped top surface 20 and a pair of sidewalls 22 which intersect at a sharp edge. Top surface 20 of each ridge 18 extends downwardly and inwardly from a location along the edge of hole 36. This orientation is shown in FIG. 2. Surfaces 20 guide the stem into the handle. Each ridge 18 extends downwardly and inwardly along the tapered handle 14 a distance equal to approximately one-third the length of the handle.

When a candle stem is inserted through hole 36 and into the handle, the ridges pierce the wax body of candle 30. Insertion of the candle wedges the stem into the handle so that the ridges pierce the candle and secure the candle in the holder. As shown in FIG. 3, the candle can be inserted within the opening in the handle so that the entire length of each ridge is forced into the stem, forming a tight friction fit holding the candle in the holder.

When the candle has been inserted into handle 14, and is lighted, the wax begins to melt. The melted wax runs down the candle body and accumulates along the floor surface 26 of cup 12.

If the entire candle is burned during one service, the cup recess 40 is sufficiently deep so that it will retain all of the candle wax. After the candle flame is extinguished, any remaining unmelted portion of the candle body is easily removed from within the opening of the handle.

Candle holders 10 may then be efficiently stored by stacking individual holders on top of each other. This is done by inserting the handle of one candle holder into the opening within the handle of the adjacent candle holder. Many holders can be stacked together and stored between uses.

The candle holder is manufactured using conventional plastic molding apparatus (not shown). The candle holder is preferably molded from polypropylene. Candle wax does not adhere to this type of plastic material. Moreover, the polypropylene is pliable so that when the wax hardens in the cup, the cup can be flexed, causing the wax to loosen from the bottom of the cup and can be easily removed.

Gussets 16 bridge the intersection between the cup wall 28 and the handle and provide support to the cup during the molding process. There are four triangularly shaped gussets in the present candle holder. The gussets are arranged equidistantly so that each gusset is separated by 90 degrees from each adjacent gusset. These gussets provide support to the cups so that during the molding process, when the candle holder is ejected from the mold, the handle will not invert from its present orientation.

Contact pads 32 are formed on floor surface 26 of the cup and are located on the floor of the cup at specific locations where ejector pins (not shown) of the molding apparatus contact the cup and eject the candle holder from the mold. Four contact pads are provided in the present candle holder. These pads are arranged equidistantly along the floor of the cup so that each pad is separated by 90 degrees from each adjacent pad.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A hand held candle holder comprising a molded plastic integral one piece body having a) a tubular handle with a closed end, an open end opposite the closed end, and an interior candle contact surface extending between said open and closed ends;

b) a cup integrally joining the handle at the open end and extending upwardly and outwardly away from the handle; and c) a plurality of elongate candle piercing ridges extending along the length of the interior contact surface of the handle and projecting radially inwardly for piercing and frictionally engaging the stem of a candle inserted into the handle.

2. A candle holder as in claim 1 wherein the cup is semispherical and flexible.

3. A candle holder as in claim 1 wherein the candle holder body is made from a non-wax adherent plastic.

4. A candle holder as in claim 3 wherein said material is polypropylene plastic.

5. A candle holder as in claim 1 wherein the tubular handle is inwardly tapered.

6. A candle holder as in claim 1 including three spaced elongate ridges.

7. A candle holder as in claim 6 wherein the ridges are separated equidistantly around the interior contact wall of the handle.

8. A candle holder as in claim 6 wherein each ridge has a sharp inwardly facing candle piercing edge.

9. A candle holder as in claim 1 including a plurality of spaced apart gusset members integral with the cup and handle, said members bridging the cup and the handle.

10. A candle holder as in claim 9 wherein the gussets are separated equidistantly around the outside of the body of the candle holder.

11. A candle holder as in claim 1 wherein the cup is flexible.

12. A candle holder as in claim 1 wherein a plurality of contact pads are located on the bottom of the cup.

13. A candle holder as in claim 12 wherein there are four contact pads.

14. A candle holder as in claim 12 wherein the contact pads are separated equidistantly around the bottom of the cup.

15. A hand held candle holder comprising an integral molded plastic body having a concave wax-collecting shield, a hollow closed handle integrally joining and extending downwardly from the bottom of the shield, the interior of the handle opening into the interior of the shield, and candle stem retention means on the interior surface of the handle for retaining the stem of a candle in place in the holder.

16. A candle holder as in claim 15 wherein said candle retention means comprises at least one ridge extending along the length of the handle.

17. A candle holder as in claim 16 including three longitudinally extending ridges spaced around the interior circumference of the handle.

18. A candle holder as in claim 17 wherein said ridges are tapered inwardly for wedge-engagement with the stem of a candle.

19. A candle holder as in claim 15 wherein said body is formed from a non-wax adherent plastic.

20. A candle holder as in claim 19 wherein said plastic is polypropylene.

21. A candle holder as in claim 15 wherein said retention means comprises an inwardly tapered portion of the interior surface of the handle.

22. A candle holder comprising:

a one piece molded integral plastic body, the body including:

a) a hollow conical handle with a lower closed end, an upper open end spaced from the closed end, an interior candle contact surface and an exterior holding surface, said surfaces extending around the handle and between said open and closed ends;

b) a concave wax collection shield integrally joined to the handle at the upper open end of the handle facing upwardly so that the interior of the handle opens into the bottom of the interior of the shield, and the interior wall of the shield extends upwardly and outwardly of the interior candle contact surface of the handle to catch melted wax flowing down from a candle inserted into the interior of the handle; and c) at least one elongate candle-piercing ridge extending longitudinally along the interior contact surface of the handle, said ridge projecting radially inwardly of the interior contact surface for piercing the stem of a candle inserted through the shield and into the interior of the handle and thereby frictionally securing the candle within the holder.

23. A candle holder as in claim 22 wherein said shield comprises a flexible semi-spherical cup.

* * * * *